United States Patent [19]

Blachura

[11] 4,187,659

[45] Feb. 12, 1980

[54] HOME BUILDING METHOD AND APPARATUS

[75] Inventor: Leon Blachura, Clarkston, Mich.

[73] Assignee: North Oakland Development Corporation, Pontiac, Mich.

[21] Appl. No.: 865,469

[22] Filed: Dec. 29, 1977

Related U.S. Application Data

[62] Division of Ser. No. 720,690, Sep. 7, 1976.

[51] Int. Cl.[2] ..... E04G 21/00

[52] U.S. Cl. ..... 52/745

[58] Field of Search ..... 52/741, 745, 430, 143, 52/122

[56] References Cited

U.S. PATENT DOCUMENTS

| | | | |
|---|---|---|---|
| 2,731,680 | 1/1956 | Bolt | 52/122 |
| 3,236,400 | 2/1966 | Turturro | 52/745 |
| 3,616,592 | 11/1971 | Rothman | 52/745 |
| 3,683,571 | 8/1972 | Walz | 52/745 |
| 3,805,365 | 4/1974 | Ashby | 29/430 |
| 3,884,494 | 5/1975 | Ashby | 52/143 |

FOREIGN PATENT DOCUMENTS

| | | | |
|---|---|---|---|
| 2309509 | 9/1973 | Fed. Rep. of Germany | 52/309.1 |
| 1415722 | 9/1965 | France | 52/143 |
| 301544 | 4/1968 | Sweden | 52/745 |

OTHER PUBLICATIONS

Excavating Engineer, Jul. 1949, pp. 14, 15, 46–48.
The New Building Block by Center for Housing & Environmental Studies Cornell Univ., 1968, p. 224.
Industrial Building by Diamont by Hiffe Books Ltd., London, vol. 1; p. 67, vol. 3, 91 WA 6400D5.

*Primary Examiner*—John E. Murtagh
*Attorney, Agent, or Firm*—Krass & Young

[57] ABSTRACT

A method and apparatus for constructing a development or subdivision of individual dwellings. A large tract of land is subdivided into lots and semi-finished roads are built to connect the lots to a public highway. The roads also connect the lots to a factory in which houses are built and from which they are transported to the lots. Suitable foundations are poured at each site, using special forms. The houses are built on jacks in the factory which support the perimeter frame of the house on a level plane. The house is lowered after completion onto a special trailer to be towed to the lot. Each house structure includes lifting rods extending from perimeter beams at the foot of the house walls. These are connected through a lifting harness to a crane for lifting the house onto the foundation. The houses are delivered progressively toward the factory, beginning at the remote ends of the tract. When all the houses have been constructed and put in place, the roads are finish surfaced and the factory is converted into a shopping center or other useful building for servicing the occupants of the houses.

1 Claim, 10 Drawing Figures

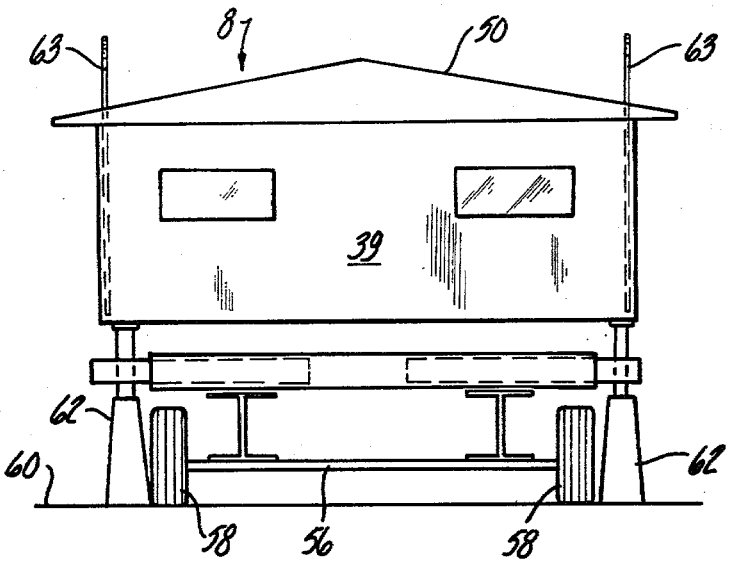
Fig-6
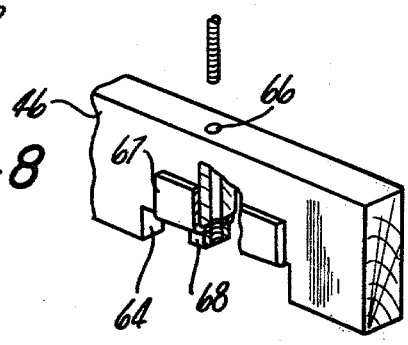
Fig-8
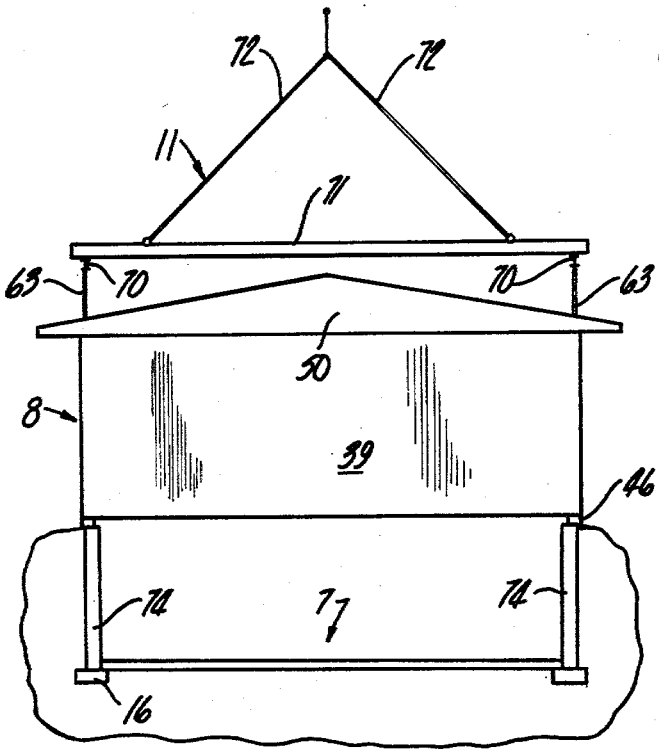
Fig-9
Fig-10
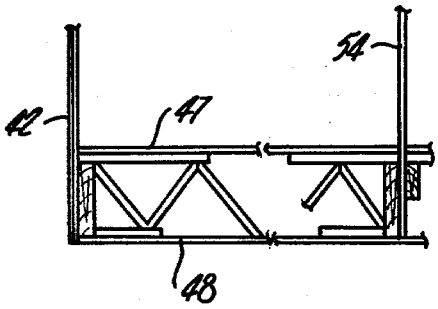

HOME BUILDING METHOD AND APPARATUS

This is a division, of application Ser. No. 720,690, filed Sept. 7, 1976.

INTRODUCTION

My invention relates in its broadest sense to a new technique for providing housing on a tract of land. More specifically, it relates to a technique for constructing individual houses in a factory and delivering them to prepared foundations on a large tract of land. Further, the invention relates to improved means for providing accurate foundations so that the prefabricated houses will mate precisely with the foundations. Additionally, the invention relates to structure of a full size dwelling house which is particularly adapted for fabrication in a factory and delivery to a homesite.

BACKGROUND AND BRIEF SUMMARY OF THE INVENTION

By way of consideration of prior art, it is known that manufacturers have built houses in factories and delivered them, by tractor-trailer or otherwise, to building lots to be placed on prepared foundations. This sort of enterprise runs into great difficulty with respect to transportation, or with respect to provision of a house of preferred dimensions, because of the limitations of transport over public roads and highways. Width limitations must be considered and, in some cases, the road must be cleared overhead obstructions to permit transportation of a large load such as a prefabricated house. Overall, such a method is inefficient and it has had little success.

It has occurred to me that such difficulties may be circumvented by the adoption of a procedure or technique involving procuring of a large tract of land, perhaps one suitable for something like 1,000 dwelling houses. With this unobstructed area available, a factory is constructed on the tract and semi-finished roads suitable for transportation of houses are built in such pattern as will ultimately be suitable for access to the houses by the tenants. These roads, which are free from obstructions, serve to provide a path for transportation of the prefabricated houses to the homesites. The transportation is most convenient and efficient if the houses are first delivered to the most remote sites and then progressively to areas nearer and nearer to the factory until the project is completed.

Special forms and techniques of setting up the forms make it possible to pour an accurately leveled and precisely dimensioned foundation for each house. The structure of the house is such as to make for efficient and economical construction of the house and also for safe and easy transport of the houses from the factory to the lots. Each house is built on a perimeter frame which is precisely leveled and which is lowered onto a transporter for the house when it is completed. The transporter includes suitable running gear such as a set of wheels. After the house is completed and lowered onto the platform, it is rolled away from the factory to the lot by a tractor.

Each house includes a strong perimeter beam at the base of the walls which enclose the house. These beams may be connected to a crane by lifting rods removably fixed to the beams and extending through the top of the walls of the house. These rods are connected to a suitable rigid frame or harness which in turn is liftable by a crane to set the house in place. After the rods are removed, the roof of the house may be shingled or otherwise finished. The platform is towed back to the factory for reuse.

After the buildings have all been constructed and delivered, the roads are resurfaced with finish coat and the fittings of the factory are removed. This is preferably a large building, of the order of an acre in floor area, and may conveniently be used to house shops or a recreation building, for example.

The principal objects of my invention are to provide the economies of factory mass fabrication to home building, with such flexibility of operation as to make it possible to construct houses of sizes which are not suited for transportation over public roads. A further object of the invention is to provide an economical and feasible process for developing a large tract of land with individual dwelling houses. A further object of the invention is to provide a dwelling house structure which is particularly adapted for transportation to its foundation. A still further object is to provide a technique for accurate pouring of foundations for the houses.

The nature of my invention and its advantages will be more fully apparent from the succeeding detailed description of a preferred mode of putting the invention into practice and the accompanying drawings thereof.

BRIEF DESCRIPTION OF THE DRAWINGS

FIG. 6 is an elevational view illustrating the construction of the house supported by jacks and the entry of the transporter;

FIG. 8 is a fragmentary view illustrating the attachment of the lifting rods to the perimeter beams of the house;

FIG. 9 illustrates the lowering of the house by a crane onto the foundation; and FIG. 10 is a detail sectional view of the house structure.

DETAILED DESCRIPTION OF THE SPECIFIC EMBODIMENT

Figure 1:
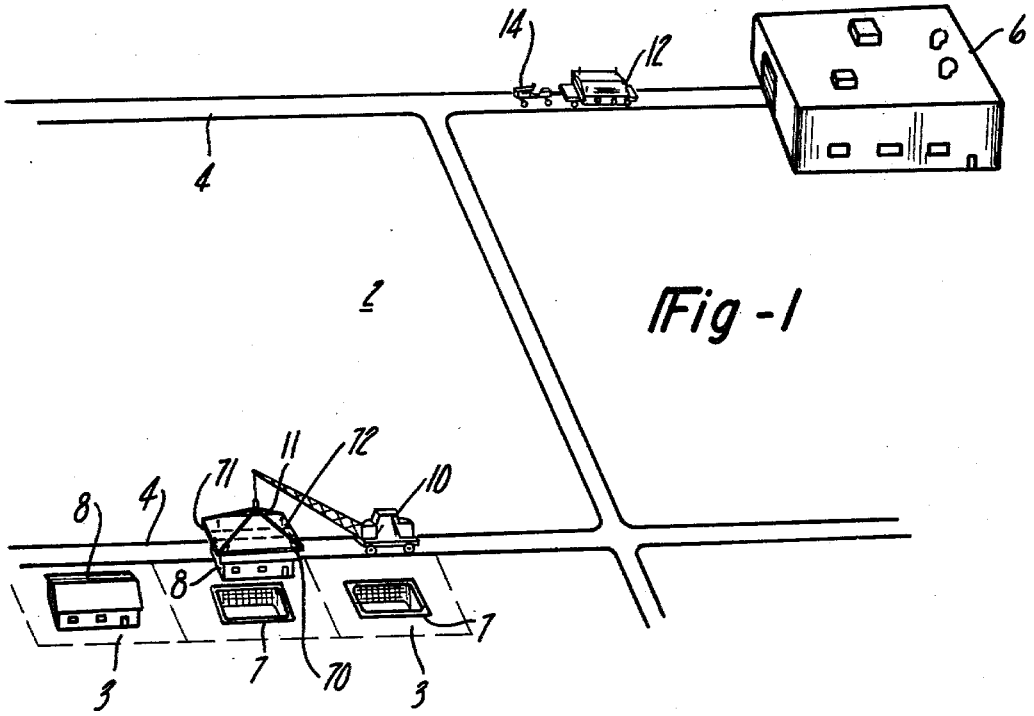
FIG. 1 is a fragmentary somewhat schematic aerial view illustrating the structure and process for developing a tract of houses.
Figure 2:
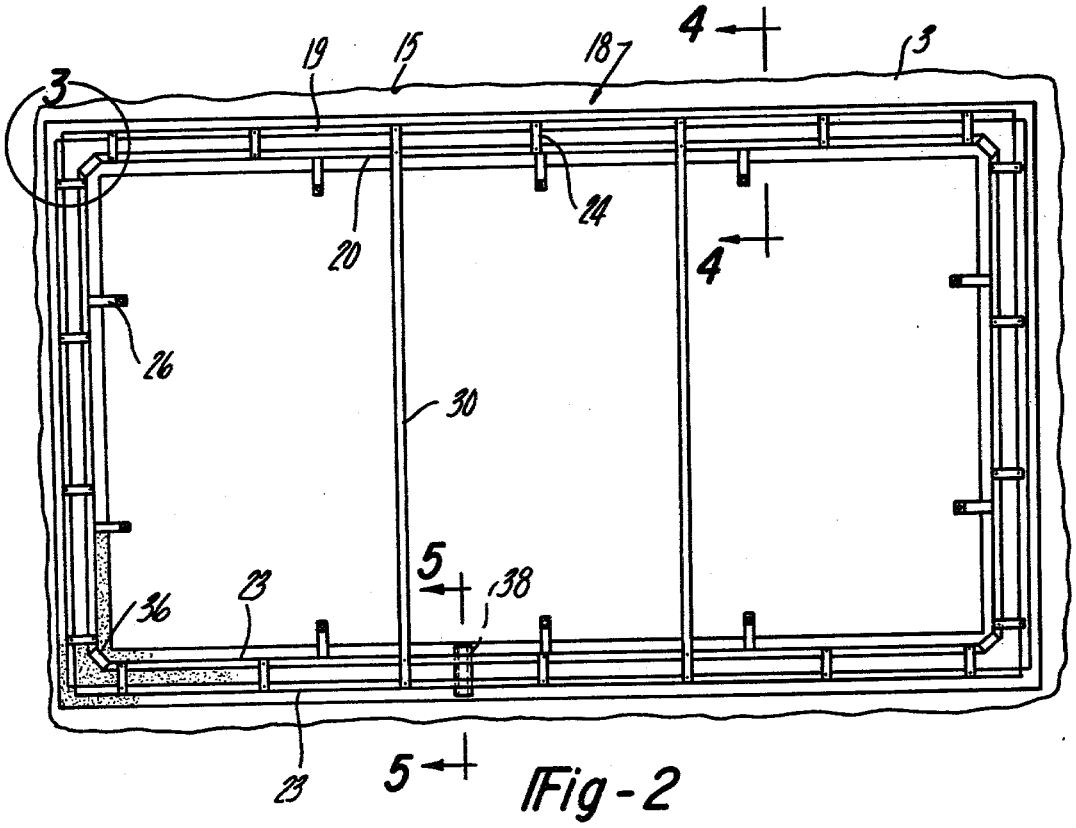
FIG. 2 is a plan view of a set of forms for pouring a house foundation.

Referring first to FIG. 1 representing an aerial view of the development, a tract of land 2 which may, for example, be of sufficient size for 500 to 2,000 houses is sub-divided into lots 3. A network of roads 4 provides for access to the lots and connects them to a factory building 6. The factory building is preferably a large building on the order of 200 feet by 200 feet and may have some 20 bays each large enough for indoor fabrication of a house.

Foundations 7 are dug and poured on each lot 3, and a house 8 is deposited onto each foundation. One house is shown on its foundation and a second house 8 is being lowered onto a foundation 7 by a mobile crane 10. The mobile crane is connected to the house by a lifting harness 11. The houses are carried to the sites on a wheeled transporter or trailer 12 which may be towed by a tractor 14. The crane 10 serves to lift the house from the platform onto the foundations.

The factory 6 is divided into bays (not illustrated) into each of which material for one house may be delivered and in which the house is constructed (see FIG. 6) and from which it is carried to the site. It will be noted that the houses are being progressively installed on the sites from a remote area of the tract toward the factory 6. This makes for more convenient handling.

For successful carrying out of my method of tract development the foundations must be accurately dimensioned to fit the prefabricated houses. Preferred techniques for accomplishing this are illustrated particularly in FIGS. 2, 3, 4 and 5. In this particular case these illustrate the construction of a foundation for a typical house having a rectangular floor plan 24 feet by 42 feet. This is, of course, merely illustrative, as various shapes and dimensions may be employed. After a suitable excavation 15 has been dug the footing 16 is poured around the perimeter of the house. The foundation or basement walls are poured into a form 18 made up of an outer rectangular template 19 and an inner rectangular template 20. The space between these defines the space into which the concrete is poured to become the basement wall. The lower edges of the templates 19 and 20 are welded or otherwise fixed to angle irons 22 and the upper edges to channel irons 23. The upper edges of the forms are held in proper spaced relation by spreaders 24 bolted to the irons 23. The lower edge of the forms are located by brackets 26 fixed to the angle irons 22 anchored, after the forms have been properly squared up, by stakes 27 driven into the ground. Similar brackets may be provided at the outer side but are unnecessary. The template walls 19 and 20 are stiffened against spreading due to the weight of the concrete by stiffeners 28. Spacer beams 30 extend across the form. Beams 30 are connected to the walls 19 and 20 to locate them by pins 31 which fit into holes in the channels 23.

Figure 3:
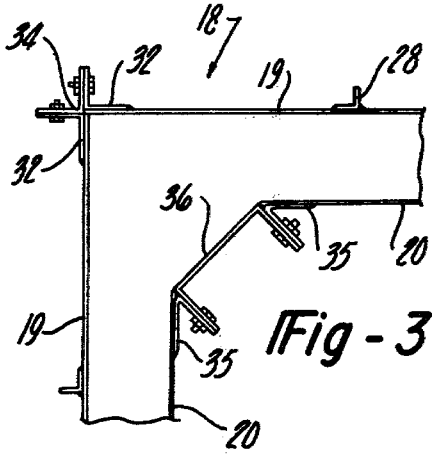
FIG. 3 is an enlarged view of a portion of FIG. 2 taken in the area indicated by the circle numbered 3 on FIG. 2.
Figure 5:
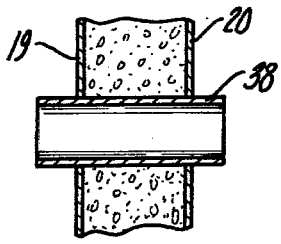
FIG. 5 is a fragmentary sectional view taken on the plane indicated by the line 5—5 in FIG. 2.

FIG. 3 shows the manner of connecting the form walls at the corners of the foundation. The vertical edges of the outer template wall 19 are welded or otherwise fixed to vertical angle irons 32. These are connected together by an angle iron 34 bolted to them. The edges of the walls of the template 20 are welded or otherwise fixed to 45° angle irons 35 which are bolted to a channel section 36.

To provide for passage of conduits through the walls, such as a drain to a septic tank, a cardboard tube 38 (FIGS. 2 and 5) may be inserted through suitable holes in the template walls 19 and 20. The form is put in place, bolted together, and suitably surveyed to assure that it is square and may be shimmed as necessary to be sure that it is level. Concrete is then poured, after which the templates are disassembled and removed from the foundation. The house may have any suitable provision for anchoring it to the foundation (not illustrated).

Windows in the foundation, or a patterned surface of the outer face of the foundation, may be provided by known techniques.

Figure 7:
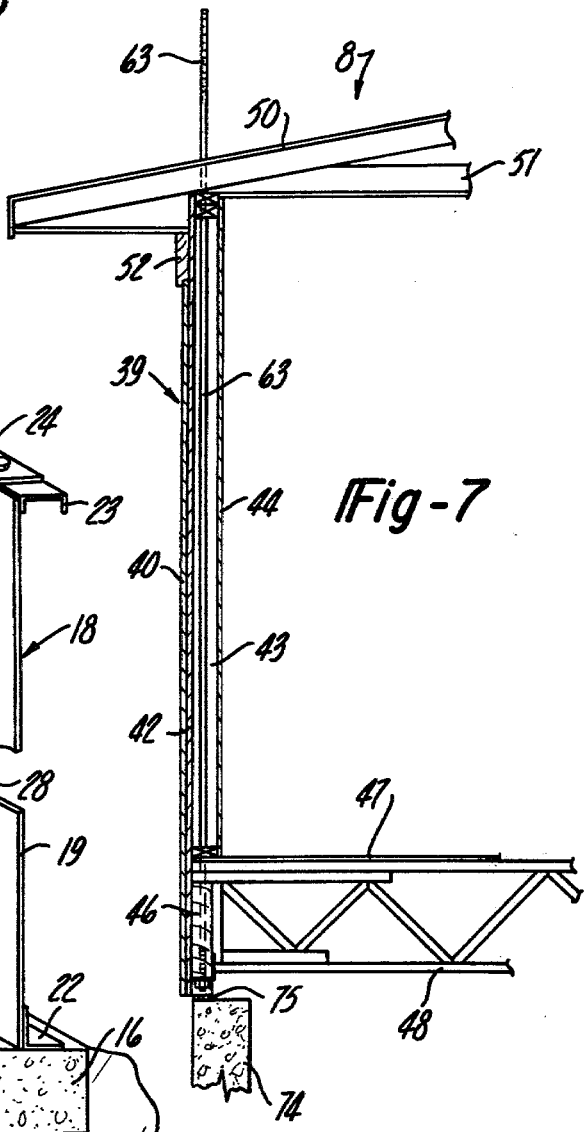
FIG. 7 is a transverse sectional view through the house illustrating the supporting rods and other details.
Figure 4:
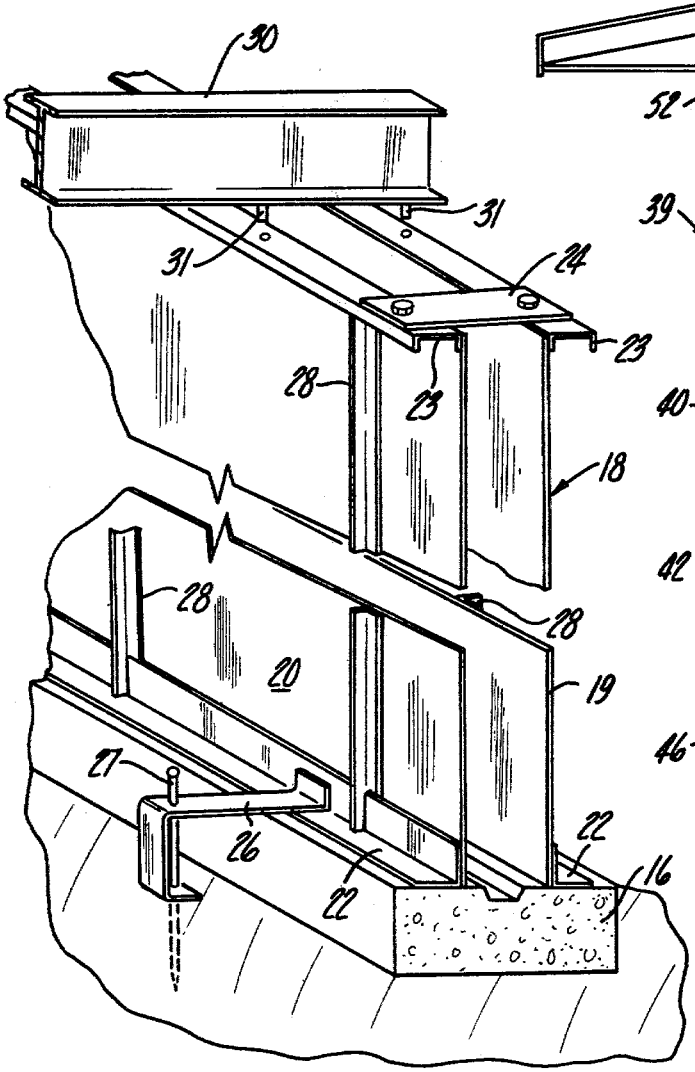
FIG. 4 is a partial isometric sectional view of the foundation forms on the plane indicated by the lines 4—4 in FIG. 2.

We may refer now to FIGS. 7, 8 and 10 for description of the structure and fabrication of the house. House 8 preferably is of rectangular outline with four outer walls 29. Each wall comprises exterior siding 40 on a plywood backing 42 glued to studs 43 and a drywall inner wall 44 fixed to the studs. The outer wall is fixed to a peripheral frame of heavy wooden beams 36 such as 16×3 inches. The floor 47 is laid on floor trusses 48 glued to the beams 46 and preferably disposed on 24-inch centers. The roof 50 is supported by roof trusses 51 mounted on top of the walls 39. The outer wall may be topped by a fascia 52. Interior room walls 54 of the house may straddle the trusses 48.

As previously indicated, the house is constructed while the peripheral beams 46 are supported level on jacks 62, as illustrated in FIG. 6. After the house is completed, a trailer or transporter 12 is pushed into place beneath the house. This trailer comprises a bed or frame 55 from which are suspended axles 56 mounting wheels 58. Outriggers 59 telescoping into the trailer frame are extended to underlie the beams 46, after which the jacks are operated to lower the house onto the transporter to be towed to the homesite.

As is obvious, the whole operation of putting the house together may be done under favorable conditions inside the factory and not be hampered by weather. Preferably, a considerable number of houses are assembled at the same time so the work may be efficiently accomplished by crews proceeding from house to house in the factory building.

The provisions for lifting the house off the platform are particularly shown in FIGS. 7, 9 and 10. Lifting rods 63 extend up through the walls 39 from the beams 46 at the corners of the house and also at points near the middle of the longer walls of the house to provide six lifting points for the assembled structure. As shown particularly in FIG. 8, the beam 46 has a notch 64 cut in its undersurface and a hole 66 extending from the notch through the top of the beam. The rod 63 extends through hole 66 and through a force distributing channel 67 bearing against the undersurface of the beam within the notch 64. The rod is attached to the beam by a nut 68 threaded onto the rod. The upper end of the rod may be threaded (not illustrated) for connection to the lifting harness 11 which comprises parallel I-beams 70 extending parallel to the longer side walls of the house joined by cross members 71 to provide a rigid rectangular frame. When the six rods 63 are attached to the harness 11, the house may be lifted without undue concentration of stress or any wracking. The harness 11 also includes cables or chains 72 by which it is connected to the lifting of the mobile crane 10. The crane lifts the house structure from the platform 12 and lowers it onto the foundation 7 where the beams 46 rest on the foundation walls 74. A felt pad 75 is preferably placed between the beams and the foundation. When the house has been put in place the nuts 68 are removed and the rods 63 are pulled out of the walls. The roof may then be shingled. If desired, the roof may be preshingled and requires only a small patch at the points where the rods have been pulled out of the roof.

When the house has been deposited on the foundation and properly aligned and fixed in place, the house may be connected to utilities and be ready for occupancy. The platform 12 is returned to the factory and building of a succeeding dwelling may be initiated on it.

When all the houses along a particular route from the factory to the boundaries of the development have been completed, the roads 4 may be surfaced or finished. This procedure eliminates the problem of damage to the road by the house-moving platforms and provides a good fresh surface over the compacted substratum for the occupants of the houses. The building and delivery of the houses will continue until the project is finished. At this time, it is assumed that all of the tract has been filled with houses and that the factory is no longer needed. The equipment of the factory may be transported to another tract for further use and the factory building 6 may be converted to any desired use as a service to the occupants of the community.

Those skilled in the art will appreciate from the foregoing description that I have devised a system providing for economical fabrication and installation of houses under factory conditions making for better use of time and material and more perfect quality control. Also, this system provides for building and installation of a large number of houses without encountering the difficulties and limitations inherent in moving completed houses over public ways. It will further be seen that the preferred method of preparing the foundation, and the method of building the house, and preferred structure of the house facilitate the accomplishment of the desired ends of providing housing on the most efficient and economical basis.

It will be appreciated the houses need not be of the same outline or internal structure. It is only necessary that each foundation accord with the dimensions of the house structure.

Although the invention has been described with such specificity as to satisfy the patent statutes, it should be understood that the descriptions are not to be construed as limiting the invention as various other implementations thereof will be apparent to those skilled in the art.

The embodiments of the invention in which an exclusive property or privilege is claimed are defined as follows:

1. A method of constructing a residential development comprising, in combination, providing a suitable unitary tract of land; constructing on the tract a factory building suitable for the simultaneous, progressive fabrication of several dwelling houses, fabricating complete houses in the factory building; delivering the houses from the factory to locations on the tract and installing the houses on the foundations; and converting the factory building on its original site to use in providing services to the occupants of the residential development upon termination of fabrication of the houses and installation on the foundations.

* * * * *